US009035562B2

(12) United States Patent
Katsuraya et al.

(10) Patent No.: US 9,035,562 B2
(45) Date of Patent: May 19, 2015

(54) IGNITION PLUG AND IGNITION APPARATUS

(75) Inventors: Kohei Katsuraya, Aichi (JP); Tatsunori Yamada, Aichi (JP); Katsutoshi Nakayama, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 475 days.

(21) Appl. No.: 13/565,937

(22) Filed: Aug. 3, 2012

(65) Prior Publication Data

US 2013/0033188 A1 Feb. 7, 2013

(30) Foreign Application Priority Data

Aug. 4, 2011 (JP) ..... 2011-170846
May 31, 2012 (JP) ..... 2012-124187

(51) Int. Cl.
*H05B 41/00* (2006.01)
*H01T 13/20* (2006.01)
*H01T 13/34* (2006.01)

(52) U.S. Cl.
CPC ..... *H01T 13/34* (2013.01); *H01T 13/20* (2013.01)

(58) Field of Classification Search
CPC ..... H05B 1/00; F02M 57/06; H01T 13/00; H01T 13/20; H01T 13/03
USPC ..... 315/209 M; 313/118, 136, 141
See application file for complete search history.

(56) References Cited

U.S. PATENT DOCUMENTS 4,568,855 A 2/1986 Nemeth et al. ..... 315/59
7,626,320 B2 12/2009 Shibata ..... 313/144
7,843,117 B2 11/2010 Jaffrezic et al. ..... 313/145
7,915,795 B2 3/2011 Jaffrezic et al. ..... 313/141
8,049,399 B2 * 11/2011 Camilli ..... 313/141
8,278,808 B2 * 10/2012 Lykowski ..... 313/141
2006/0220510 A1 10/2006 Shibata ..... 313/141

(Continued)

FOREIGN PATENT DOCUMENTS

FR 1.298.383 11/1962
JP 40-23530 10/1940

(Continued)

OTHER PUBLICATIONS

Notification of Reasons for Rejection (dated Jul. 2, 2013) issued in connection with corresponding Japanese Patent Application No. 2012-124187, with English translation.

(Continued)

*Primary Examiner* — Hai L Nguyen
(74) *Attorney, Agent, or Firm* — Kusner & Jaffe

(57) ABSTRACT

A technique for lowering power loss involved in supply of high-frequency electric power to an ignition plug. The ignition plug includes a tubular insulator having an axial bore extending therethrough; a center electrode disposed in the axial bore; a metal terminal disposed rearward of the center electrode in the axial bore, electrically connected to the center electrode, and supplied with high-frequency electric power from an external source; a metallic shell disposed to circumferentially surround the insulator; and a ground electrode electrically connected to the metallic shell and adapted to generate plasma in cooperation with the center electrode through supply of high-frequency electric power to the metal terminal. At least a portion of the inner surface of the axial bore is coated with metal coating. The center electrode and the metal terminal are in electrical contact with the metal coating.

10 Claims, 7 Drawing Sheets

(56) References Cited

U.S. PATENT DOCUMENTS

| | | | | |
|---|---|---|---|---|
| 2007/0188063 | A1 | 8/2007 | Lykowski | 313/137 |
| 2007/0188064 | A1 | 8/2007 | Lykowski | 313/141 |
| 2008/0018216 | A1 | 1/2008 | Camilli | 313/141 |
| 2012/0142243 | A1 | 6/2012 | Camilli | 445/7 |

FOREIGN PATENT DOCUMENTS

| | | | |
|---|---|---|---|
| JP | 2008-529229 | 7/2008 | H01T 13/54 |
| JP | 2009-527078 | 7/2009 | H01T 13/20 |
| JP | 2010-135345 | 6/2010 | H01T 13/20 |
| JP | 4859846 | 11/2011 | |
| JP | 4869351 | 11/2011 | H01T 13/44 |
| WO | WO 2008/011591 | 1/2008 | |

OTHER PUBLICATIONS

European Search Report (dated May 9, 2014) issued in connection with corresponding European Patent Application No. 12179249.3.

* cited by examiner

IGNITION PLUG AND IGNITION APPARATUS

FIELD OF THE INVENTION

The present invention relates to an ignition plug and an igniter.

BACKGROUND OF THE INVENTION

According to a known technique of an ignition plug for igniting fuel in an internal combustion engine, a spark gap is formed between a center electrode and a ground electrode, and plasma is generated between the electrodes (refer to, for example, U.S. Pat. No. 4,568,855 "Patent Document 1" and Japanese Patent Application Laid-Open No. JP 2009-527078 "Patent Document 2"). Also, there is a known technique of supplying high-frequency electric power to the center electrode for generating plasma between the electrodes (refer to, for example, Japanese Patent Application Laid-Open No. JP 2008-529229 "Patent Document 3").

SUMMARY OF THE INVENTION

Problems to be Solved by the Invention

When high-frequency electric power is supplied to the center electrode from an external AC power supply, in some cases, a large power loss has arisen in a path extending from a metal terminal connected to the AC power supply to the center electrode, due to presence of a resistance component therein. In some cases, as a result of generation of a large power loss, plasma having a desired size has failed to be generated between the electrodes of an ignition plug, leading to misfire.

The present invention has been conceived to solve, at least partially, the above problem, and an object of the invention is to provide a technique for lowering power loss involved in supply of high-frequency electric power to an ignition plug.

SUMMARY OF THE INVENTION

Application Example 1

An ignition plug comprises a tubular insulator having an axial bore extending therethrough in a direction of an axis; a center electrode disposed in a forward end portion of the axial bore; a metal terminal disposed rearward of the center electrode in the axial bore, electrically communicating with the center electrode, and supplied with high-frequency electric power from an external source; a metallic shell disposed in such a manner as to circumferentially surround the insulator; and a ground electrode electrically connected to the metallic shell and adapted to generate plasma in cooperation with the center electrode through supply of the high-frequency electric power to the metal terminal. At least a portion of an inner surface of the axial bore is coated with metal coating. The metal terminal and the center electrode electrically communicate with each other through electrical contact of the center electrode with the metal coating and through electrical contact of the metal terminal with the metal coating at a position located rearward of the center electrode.

According to the ignition plug described in application example 1, the metal coating is provided on the inner surface of the axial bore and establishes electrical communication between the metal terminal and the center electrode. By virtue of this, a current (power) path (may also be called an "electrical path") extending from the metal terminal to the center electrode can be increased in cross-sectional area. Therefore, the electrical path extending from the metal terminal to the center electrode can be reduced in resistance, whereby power loss that arises in the electrical path can be reduced.

Application Example 2

In the ignition plug described in application example 1, the metal coating extends on the inner surface of the axial bore at least from a position of the center electrode toward a rear end of the insulator with respect to the direction of the axis, and the metal terminal is in electrical contact with the metal coating at a position within a region extending 20 mm forward from a rear end of the metal coating with respect to the direction of the axis.

According to the ignition plug described in application example 2, the metal terminal is in electrical contact with the metal coating at a position within a region extending 20 mm forward from the rear end of the metal coating, whereby there can be restrained a reduction in size of plasma generated through supply of high-frequency electric power to the metal terminal.

Application Example 3

In the ignition plug described in application example 1 or 2, the metal coating is formed at least from a rear end surface of the insulator to the position of the center electrode on the inner surface of the axial bore, and the metal terminal is in electrical contact with the metal coating on the rear end surface of the insulator.

According to the ignition plug described in application example 3, by utilizing the rear end surface on which the metal coating is formed, the metal terminal and the metal coating can be electrically connected to each other.

Application Example 4

In the ignition plug described in application example 1 or 2, the insulator has an insulator threaded portion having internal threads, formed on the inner surface of the axial bore at a position located rearward of the position of the center electrode, and adapted to mount the metal terminal; the metal terminal has a terminal threaded portion having external threads, disposed in the axial bore, and threadingly engaged with the insulator threaded portion; the metal coating is formed on the inner surface of the axial bore at least from the insulator threaded portion to the position of the center electrode; and the metal terminal is in electrical contact with the metal coating through threading engagement between the insulator threaded portion and the terminal threaded portion.

According to the ignition plug described in application example 4, the metal terminal and the metal coating are in electrical contact with each other through threading engagement between the insulator threaded portion and the terminal threaded portion. Therefore, the electrical contact between the metal terminal and the metal coating can be stably maintained.

Application Example 5

In the ignition plug described in any one of application examples 1 to 4, the metal coating is higher in electrical conductivity than the metal terminal.

According to the ignition plug described in application example 5, the resistance of the electrical path can be further reduced, whereby power loss that arises in the electrical path can be further reduced.

Application Example 6

In the ignition plug described in any one of application examples 1 to 5, the metal coating is a layer formed from one metal selected from a group of metals consisting of Cu, Ni, Ag, Pt, Rh, Au, W, Co, Be, Ir, Zn, Mg, Al, and Mo, or an alloy which contains as a main component one or more metals selected from the group.

According to the ignition plug described in application example 6, the metal coating layer is formed from a predetermined metal or a predetermined alloy, whereby the resistance of the electrical path can be reduced, and thus, power loss that arises in the electrical path can be reduced.

Application Example 7

The ignition plug described in any one of application examples 1 to 6 further comprises an electrically conductive glass seal layer gaplessly provided within the axial bore between the metal terminal and the center electrode. In the ignition plug, a forward end of the metal terminal and a rear end of the center electrode are in contact with the electrically conductive glass seal.

According to the ignition plug described in application example 7, the electrically conductive glass seal can establish electrical communication between the metal terminal and the center electrode and can ensure a seal within the axial bore.

Application Example 8

An igniter comprises an ignition plug described in any one of application examples 1 to 7, and a high-frequency electric power supply for supplying high-frequency electric power to the metal terminal of the ignition plug.

Application example 8 can provide an igniter which uses an ignition plug whose power loss is reduced.

The present invention can be embodied in various forms. For example, the present invention can be embodied in a method of manufacturing an ignition plug, and a vehicle in which an ignition plug is mounted, in addition to an ignition plug and an igniter having an ignition plug.

DETAILED DESCRIPTION OF THE INVENTION

Modes for carrying out the present invention will be described in the following order:

A to C: Embodiments and experimental results
D: Modifications

A. First Embodiment

A-1. Configuration of Igniter

Figure 1:
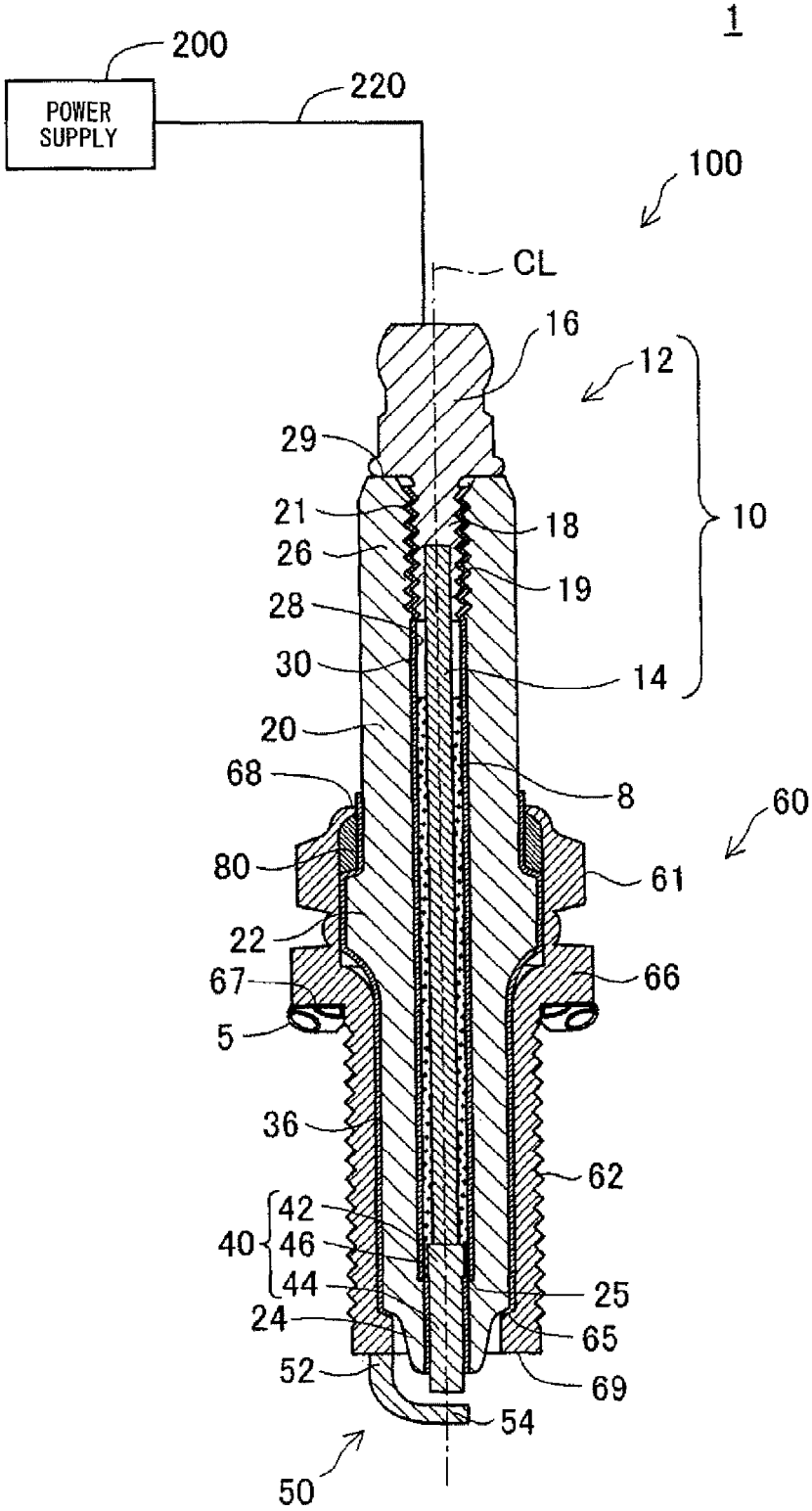
FIG. 1 is an explanatory view showing an igniter 1 according to a first embodiment of the present invention.

FIG. 1 is an explanatory view showing an igniter 1 according to a first embodiment of the present invention. In FIG. 1, an ignition plug 100 is shown in section. In FIG. 1, the direction of an axis CL of the ignition plug 100 is referred to as the vertical direction; the lower side of the ignition plug 100 is referred to as the forward side of the ignition plug 100; and the upper side of the ignition plug 100 is referred to as the rear side of the ignition plug 100. A section of the ignition plug 100 taken orthogonally to the direction of the axis CL may also be called a "cross section,"

The igniter 1 includes the ignition plug 100 for generating high-frequency plasma and a power supply 200 for supplying power to the ignition plug 100. The power supply 200 includes a high-frequency electric power supply and can supply high-frequency electric power to the ignition plug 100. The frequency of high-frequency electric power is, for example, 50 kHz to 100 MHz.

A-2. Configuration of Ignition Plug

The ignition plug 100 includes a tubular insulator 20; a center electrode 40; a metal terminal 10; a ground electrode 50; and a metallic shell 60.

The insulator 20 has an axial bore 28 extending therethrough in the direction of the axis CL. The axial bore 28 has a circular cross section. In the present embodiment, the insulator 20 has a length of 70 mm along the direction of the axis CL. The insulator 20 is formed from alumina or the like by firing. The insulator 20 has a flange portion 22 having the greatest outside diameter and located substantially at the center thereof with respect to the direction of the axis CL. The insulator 20 also has an insulator threaded portion 21 having internal threads and formed on the inner circumferential surface of a rear end portion 26 located rearward of the flange portion 22 and near a rear end surface 29 thereof. The inner circumferential surface of the tubular insulator 20 is also called the inner surface of the axial bore 28. The insulator threaded portion 21 is formed at a position located rearward of the center electrode 40. The insulator 20 has a forward end portion 24, including the forward end thereof, located forward of the flange portion 22 and being smaller in outside diameter than the rear end portion 26. The forward end portion 24 reduces in outside diameter toward the forward end thereof. When the ignition plug 100 is mounted to the engine head of an internal combustion engine (not shown), the forward end portion 24 is exposed to the interior of a combustion chamber of the engine. Also, the insulator 20 has a stepped portion 25 formed on the inner circumferential surface thereof and located at a position between the forward end portion 24 and the flange portion 22 with respect to the direction of the axis CL. The stepped portion 25 is formed by imparting different diameters to the axial bore 28.

The center electrode 40 is a rodlike electrode disposed in a forward end portion of the axial bore 28. The center electrode 40 is formed from metal, which is an electrically conductive material. In the present embodiment, the center electrode 40 is formed from an alloy which contains nickel (Ni) as a main component. The center electrode 40 is held in the axial bore 28 in such a manner that its forward end projects from the forward end of the insulator 20. The center electrode 40 includes a forward center electrode 44 located on the forward side and a rear center electrode 42 located on the rear side. The forward center electrode 44 and the rear center electrode 42 have a circular columnar shape. The forward center electrode 44 is smaller in outside diameter than the rear center electrode 42. A gap is formed between the outer circumferential surface of the rear center electrode 42 and the inner surface of the axial bore 28. A stepped portion 46 is formed at the boundary between the forward center electrode 44 and the rear center electrode 42 with respect to the direction of the axis CL. When the center electrode 40 is inserted into the axial bore 28 from the rear end of the insulator 20, the stepped portion 46 of the center electrode 40 is caught by the stepped portion 25 of the insulator 20. By virtue of this, the center electrode 40 is positioned in the axial bore 28. The center electrode 40 is in contact with a metal coating 30 formed on the inner surface of a forward end portion, including the stepped portion 25, of the axial bore 28 with respect to the direction of the axis CL.

The metallic shell 60 is a circular columnar metal member formed from metal, such as a low-carbon steel, and is utilized for fixing the ignition plug 100 to the engine head of an internal combustion engine. The metallic shell 60 is disposed in such a manner as to circumferentially surround the insulator 20 (specifically, a portion of the insulator 20 extending from the vicinity of the flange portion 22 to the vicinity of the forward end portion 24), and holds the insulator 20 therein. The metallic shell 60 includes a tool engagement portion 61, a mounting threaded portion 62, and a seal portion 66.

The tool engagement portion 61 is where a spark plug wrench (not shown) is engaged. The mounting threaded portion 62 is where threads are formed on an outer circumferential surface, and is threadingly engaged with a mounting threaded hole of the engine head of the internal combustion engine. The seal portion 66 is formed between the mounting threaded portion 62 and the tool engagement portion 61 with respect to the direction of the axis CL and assumes the form of a flange such that its outer circumferential surface projects radially outward. An annular gasket 5 formed by folding a sheet is disposed on a forward end surface 67 of the seal portion 66. When the ignition plug 100 is mounted to the engine head, the gasket 5 is crushed, thereby establishing a seal between the ignition plug 100 and the engine head.

The metallic shell 60 has a thin-walled crimp portion 68 located rearward of the tool engagement portion 61. A powder of talc 80 is filled into a space between the inner circumferential surface of a rear end portion of the metallic shell 60 and the outer circumferential surface of the insulator 20. The crimp portion 68 is bent inward for crimping, thereby pressing the insulator 20 toward the forward end of the metallic shell 60 via the talc 80. By this procedure, a forward end portion of the insulator 20 is supported by a stepped portion 65 of the metallic shell 60. The mounting threaded portion 62 is formed on an outer circumferential surface of the metallic shell 60 located forward of the seal portion 66 and is utilized for mounting the ignition plug 100 to the internal combustion engine.

The metal terminal 10 includes a first terminal 12 and a second terminal 14. The first and second terminals 12 and 14 are formed from metal, which is an electrically conductive material. In the present embodiment. The first and second terminals 12 and 14 are formed from an alloy which contains iron (Fe) as a main component. The first terminal 12 is disposed such that a terminal forward portion 18 is disposed within the axial bore 28, while a terminal rear portion 16 projects outward from the rear end surface 29 of the insulator 20. A cable 220 is connected to the terminal rear portion 16 for electrically connecting the terminal rear portion 16 to the power supply 200, whereby the terminal rear portion 16 is supplied with power from the power supply 200. The terminal forward portion 18 has a terminal threaded portion 19 having external threads and formed on its outer circumferential surface. By threadingly engaging the terminal threaded portion 19 and the insulator threaded portion 21 together, the first terminal 12 is mounted to the insulator 20. The second terminal 14 is a circular columnar member extending in the direction of the axis CL. The rear end of the second terminal 14 is connected to the first terminal 12, and the forward end of the second terminal 14 is connected to the center electrode 40. More specifically, a rear end portion of the second terminal 14 is fixedly inserted into the terminal forward portion 18. A forward end portion of the second terminal 14 is fixed to the rear center electrode 42 by resistance welding or the like. By this structural feature, an electrical path is formed for supplying power supplied to the first terminal 12 to the center electrode 40. A portion of the gap between the second terminal 14 and the insulator 20 in the axial bore 28 is filled with a powder of talc 8.

The ground electrode 50 is formed from metal, which is an electrically conductive material. In the present embodiment, the ground electrode 50 is formed from an alloy which contains Ni as a main component (e.g., INCONEL (trade name) 600 or 601). The ground electrode 50 is formed by bending a plate-like member into a shape resembling the letter L. A proximal portion 52 located on a side toward one end of the ground electrode 50 is joined by welding to a forward end surface 69 of the metallic shell 60. The ground electrode 50 is bent such that a distal end portion 54 located on a side toward its other end faces the forward end surface of the center electrode 40. In other words, the ground electrode 50 is bent such that the distal end portion 54 is orthogonal to the direction of the axis CL. A spark gap is formed between the forward end of the center electrode 40 and the distal end portion 54 of the ground electrode 50 for generating plasma. In the present embodiment, the spark gap is 0.5 mm.

Metal coating (may also be called the "metal film") 30 is formed on the inner surface of the axial bore 28 (the insulator 20) for forming an electrical path. In the present embodiment, the metal coating 30 is formed on the inner surface of the axial bore 28 along the entire circumference. Also, in the present embodiment, the metal coating 30 is formed from the rear end to the forward end of the axial bore 28 with respect to the direction of the axis CL. That is, the rear end of the metal coating 30 is located at the rear end of the insulator threaded portion 21, and the forward end of the metal coating 30 is located at the forward end of the axial bore 28. The metal coating 30 is in electrical contact with the metal terminal 10 at its rear end portion and in electrical contact with the center electrode 40 at its forward end portion. Thus, the metal coating 30 establishes electrical connection between the metal terminal 10 and the center electrode 40. The metal coating 30 is formed from an electrically conductive material. For example, the metal coating 30 is a layer formed from one metal selected from a group of metals consisting of Cu, Ni, Ag, Pt, Rh, Au, W, Co, Be, Ir, Zn, Mg, Al, and Mo, or an alloy which contains as a main component one or more metals selected from the group. In order to reduce electrical resistance of the metal coating 30 for reducing power loss, preferably, the metal coating 30 is higher in electrical conductivity than the metal terminal 10. In the present embodiment, the metal coating 30 is formed from Ni. The metal coating 30 can be formed, for example, by mixing metal powder into an organic solvent and applying the resultant paste onto the inner surface of the axial bore 28. The metal coating 30 may have a multilayer structure.

A metal coating 36 is formed on a portion of the outer circumferential surface of the insulator 20 which corresponds to the metallic shell 60. The metal coating 36 is formed along the entire circumference of the outer circumferential surface of the insulator 20, from a position located rearward of a region which faces the crimp portion 68 of the metallic shell 60, to a region which faces the stepped portion 65 of the metallic shell 60. The metal coating 36 is formed so as to fill the gap between the metallic shell 60 and the insulator 20 on a forward side of the ignition plug 100. At least a portion of the metal coating 36 is in contact with the metallic shell 60, thereby being electrically connected to the metallic shell 60. Similar to the metal coating 30, the metal coating 36 is formed from an electrically conductive material. For example, the metal coating 36 is a layer formed from one metal selected from a group of metals consisting of Cu, Ni, Ag, Pt, Rh, Au, W, Co, Be, Ir, Zn, Mg, Al, and Mo, or an alloy which contains as a main component one or more metals selected from the group.

As mentioned above, according to the ignition plug 100 of the first embodiment, the metal terminal 10 and the center electrode 40 are directly connected to each other and are electrically connected to each other via the metal coating 30. That is, the ignition plug 100 has an electrical path for supplying power to the center electrode 40 through the metal terminal 10, and an electrical path for supplying power to the center electrode 40 through the metal terminal 10 and the metal coating 30. Thus, the path (electrical path) of current (power) extending from the terminal rear portion 16 which is directly connected to the power supply 200 and is supplied with high-frequency electric power, to the center electrode 40 can be increased in cross-sectional area. By virtue of this, the resistance of the electrical path can be reduced. Thus, the power loss of the ignition plug 100 can be reduced. Therefore, plasma whose size is increased to such an extent as not to cause misfire can be stably generated. Also, since the ignition plug 100 is such that the metal coating 30 is formed along the entire circumference of the axial bore 28, as compared with the case where the metal coating is not formed along the entire circumference, the electrical path can be further increased in cross-sectional area. Therefore, the resistance of the electrical path can be further reduced. Accordingly, power loss can be further reduced.

Also, the ignition plug 100 is such that the metal coating 30 is also formed on the insulator threaded portion 21. Thus, through threading engagement between the insulator threaded portion 21 and the terminal threaded portion 19, the electrical contact between the metal terminal 10 and the metal coating 30 can be favorably maintained. By virtue of this, even when external force, such as vibration, is applied to the ignition plug 100, there can be reduced a possibility of cutting off the electrical connection which is established between the metal terminal 10 and the center electrode 40 via the metal coating 30. In the first embodiment, the metal coating 30 is formed up to the rear end of the insulator threaded portion 21. However, the metal coating 30 may be partially formed on the insulator threaded portion 21. Even in this case, by virtue of formation of the metal coating 30 on the insulator threaded portion 21, the electrical contact between the metal terminal 10 and the metal coating 30 can be favorably maintained.

Figure 2A:
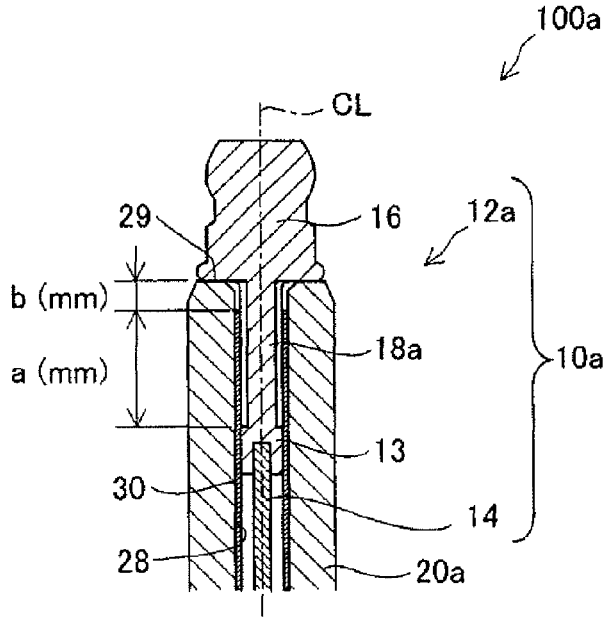
FIGS. 2A and 2B are views for explaining a preferred mode of the first embodiment.
Figure 2B:
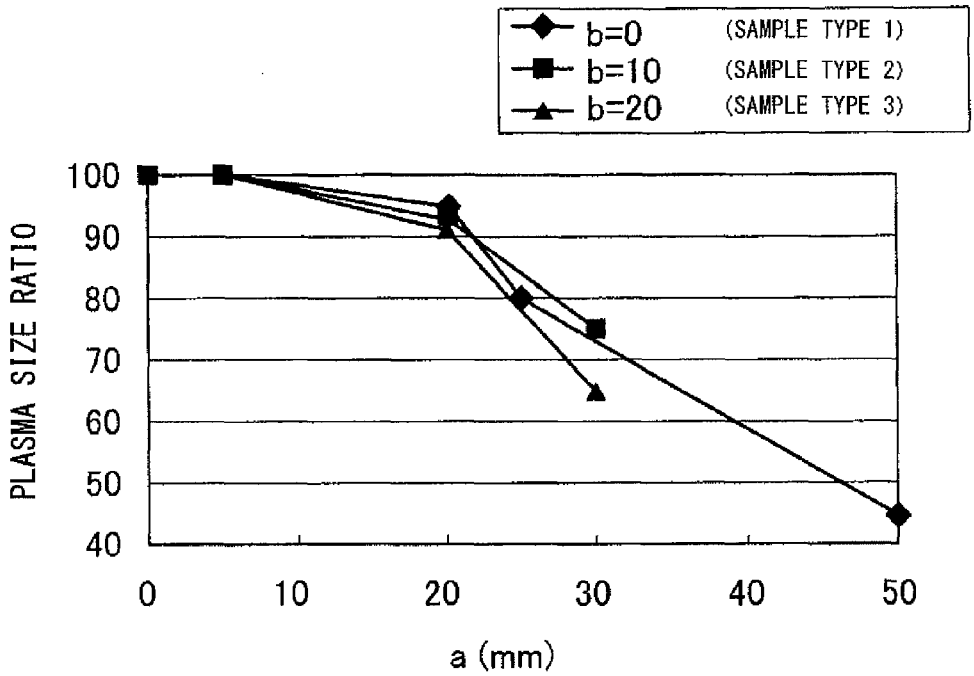

FIGS. 2A and 2B are views for explaining a preferred mode of the first embodiment. FIG. 2A is a view for explaining an ignition plug 100*a* used in an experiment. FIG. 2B is a view showing experimental results. FIG. 2A is a sectional view showing the terminal rear portion 16 and its vicinity of the ignition plug 100*a*. The ignition plug 100*a* differs from the ignition plug 100 of the first embodiment in a mode of contact between the first terminal 12 and the metal coating 30. Other configurational features are similar to those of the first embodiment and are thus denoted by like reference numerals, and repeated description thereof is omitted.

As shown in FIG. 2A, an insulator 20*a* of the ignition plug 100*a* does not have an insulator threaded portion. Also, a metal terminal 10*a* does not have a terminal threaded portion. The metal coating 30 is formed on the inner surface of the axial bore 28 along the entire circumference of the inner surface. The rear end of the metal coating 30 is located b millimeter forward from the rear end surface 29 with respect to the direction of the axis CL. Similar to the first embodiment, the forward end of the metal coating 30 is located at the forward end of the axial bore 28. Also, similar to the first embodiment, a forward end portion of the metal coating 30 is in electrical contact with the center electrode 40. A terminal forward portion 18*a* is inserted into the axial bore 28, and a forward end subportion of the terminal forward portion 18*a*; i.e., a diameter-expanded portion 13, is in electrical contact with the metal coating 30 along the entire circumference. This establishes electrical communication between the metal terminal 10*a* and the metal coating 30. A first terminal 12*a* and the metal coating 30 are in electrical contact with each other at a position located a millimeter forward from the rear end of the metal coating 30 with respect to the direction of the axis CL.

Samples of the ignition plug 100*a* which differed in the lengths a and b were prepared and subjected to the following experiment. More specifically, there were prepared the ignition plugs 100*a* of sample type 1 having a length b of 0 mm, sample type 2 having a length b of 10 mm, and sample type 3 having a length b of 20 mm. The ignition plugs 100*a* of each sample type which differed in length a were subjected to the experiment. The experiment was conducted as follows: the ignition plugs 100*a* were disposed such that their forward ends were located within a chamber having a pressure of 0.2 Mpa, and a high-frequency electric power of 300 W having a frequency of 13 MHz was supplied to their metal terminals 10 for 1 msec. The ignition plugs 100*a* were evaluated for the size of generated plasma. A generated plasma was image-captured, and the size (area) of the plasma was calculated from the captured image. The vertical axis of FIG. 2B represents the ratio of the size of plasma generated at a certain length a to the size of plasma generated at a length a of 0 mm, which size is taken as 100.

As shown in FIG. 2B, the samples of sample types 1, 2, and 3 having a length a in excess of 20 mm exhibited an abrupt reduction in plasma size ratio. A conceivable reason for this is as follows: when the length a exceeds 20 mm, the resistance of the metal coating 30 has increased in relation to the case of a length a of 0 mm, causing an increase in power loss. By contrast, the samples of sample types 1, 2, and 3 having a length a of 20 mm or less were able to generate plasma whose size was 90% or more of the size of plasma generated by the samples having a length a of 0 mm.

As mentioned above, in order to prevent a reduction in the size of plasma generated between the center electrode 40 and the ground electrode 50, preferably, the metal terminal 10*a* is in electrical contact with the metal coating 30 at a position within a region extending 20 mm forward from the rear end of the metal coating 30. This restrains a reduction in the size of plasma generated between the electrodes 40 and 50 when a fixed high-frequency electric power is supplied to the metal terminal 10*a*. Similarly, preferably, the ignition plug 100 of the first embodiment and ignition plugs 100*b* and 100*c* of embodiments to be described below have a length a of 20 mm or less.

B. Second Embodiment

Figure 3:
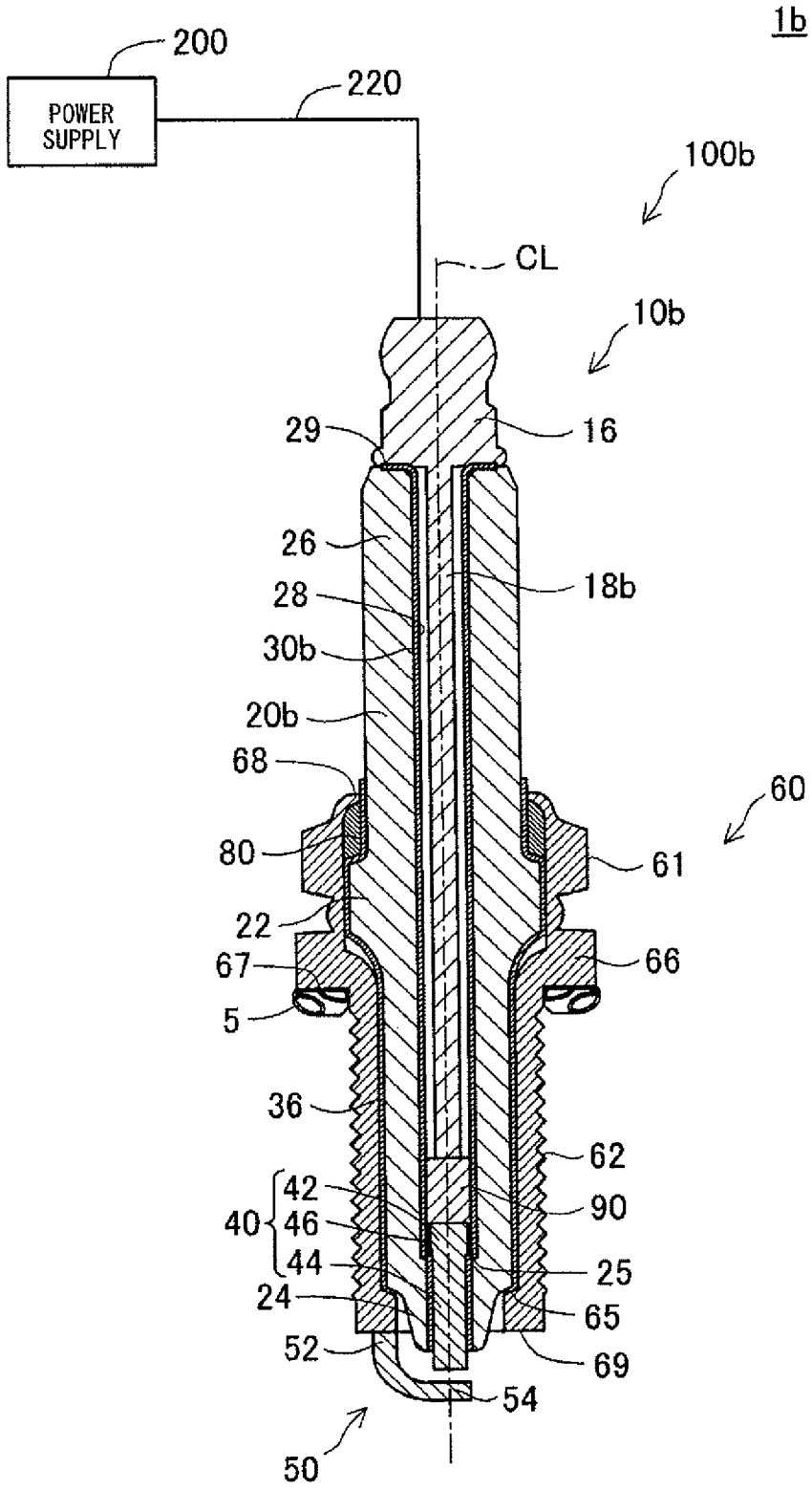
FIG. 3 is an explanatory view showing an igniter 1*b* according to a second embodiment of the present invention.

FIG. 3 is an explanatory view showing an igniter 1*b* according to a second embodiment of the present invention.

In FIG. 3, the ignition plug 100*b* is shown in section. The igniter 1*b* differs from the igniter 1 (FIG. 1) of the first embodiment described above in the configuration of the ignition plug 100*b*. More specifically, the igniter 1*b* differs from the igniter 1 in the configuration of a metal terminal 10*b* and an insulator 20*b* of the ignition plug 100*b* and in the position of formation of a metal coating 30*b*. Also, the ignition plug 100*b* additionally has an electrically conductive glass seal layer 90. Other configurational features are similar to those of the first embodiment and are thus denoted by like reference numerals, and repeated description thereof is omitted.

The insulator 20*b* does not have an insulator threaded portion. Also, the metal terminal 10*b* does not have a terminal threaded portion. A terminal forward portion 18*b* of the metal terminal 10*b* extends to the vicinity of the center electrode 40. The ignition plug 100*b* has the electrically conductive glass seal layer 90. The electrically conductive glass seal layer 90 fills a space in the axial bore 28 between the metal terminal 10*b* and the center electrode 40, thereby establishing an electrical connection between the metal terminal 10*b* and the center electrode 40. The electrically conductive glass seal layer 90 is gaplessly provided in the axial bore 28 between the metal terminal 10*b* and the center electrode 40, thereby ensuring a seal within the axial bore 28. That is, the electrically conductive glass seal layer 90 is charged into the axial bore 28 in such a manner as to divide the axial bore 28 in two in the direction of the axis CL. The electrically conductive glass seal layer 90 is formed from a metal powder which predominantly contains one or more metals selected from among Cu, Sn, Fe, etc. If necessary, the electrically conductive glass seal layer 90 may additionally contain a semiconductive inorganic compound powder, such as $TiO_2$, in an appropriate amount.

The metal coating 30*b* is formed in such a manner as to extend from the rear end surface 29 of the insulator 20*b* to the forward end of the inner surface of the axial bore 28. The metal coating 30*b* is formed on the inner surface of the axial bore 28 along the entire circumference of the inner surface and is annularly formed on the rear end surface 29. The forward end surface of the terminal rear portion 16 of the metal terminal 10*b* is in contact with the rear end surface 29, thereby being in electrical contact with the metal coating 30*b*.

The electrically conductive glass seal layer 90 can be formed, for example, as follows. The center electrode 40 is inserted into and disposed in the axial bore 28 of the insulator 20*b* whose inner surface is coated with the metal coating 30*b*. Next, a glass powder which will become the electrically conductive glass seal layer 90 is charged into the axial bore 28 as shown in FIG. 3. Then, the charged glass powder is preliminarily compressed from opposite sides with respect to the direction of the axis CL. Subsequently, as shown in FIG. 3, the metal terminal 10*b* is disposed in such a manner that its forward end comes into contact with the electrically conductive glass seal layer 90. Then, the metal terminal 10*b*, the glass powder, and the center electrode 40 disposed in the insulator 20*b* are heated to a predetermined temperature of 800° C. to 950° C. equal to or higher than the softening point of glass. Subsequently, the metal terminal 10*b* is pressed forward from the rear side. By this procedure, the electrically conductive glass seal layer 90 is formed.

As mentioned above, the ignition plug 100*b* of the second embodiment is such that the metal terminal 10*b* and the metal coating 30*b* are in electrical contact with each other on the rear end surface 29 of the insulator 20*b*. By virtue of this, electrical contact can be stably maintained between the metal terminal 10*b* and the metal coating 30*b*. That is, by bringing the metal terminal 10*b* and the metal coating 30*b* into contact with each other on the rear end surface 29, which is a plane substantially orthogonal to the direction of the axis CL, better contact can be established than in the case where the metal terminal 10*b* and the metal coating 30*b* are brought into contact with each other on a curved surface (e.g., on the inner surface of the axial bore 28). Also, since the rear end surface 29 is an outer surface of the insulator 20*b*, the metal terminal 10*b* and the metal coating 30*b* can be readily brought into electrical contact with each other. Also, the ignition plug 100*b* has the electrically conductive glass seal layer 90 disposed within the axial bore 28. By virtue of this, the metal terminal 10*b* and the center electrode 40 can be electrically connected to each other, and a seal can be ensured within the axial bore 28. Since, similar to the first embodiment, the ignition plug 100*b* is such that the metal coating 30*b* establishes an electrical connection between the metal terminal 10*b* and the center electrode 40, the resistance of the electrical path can be reduced. Accordingly, power loss can be reduced. The electrically conductive glass seal layer 90 may be applied to other embodiments (e.g., the first embodiment).

C. Experimental Results Showing One of Effects

Figure 4:
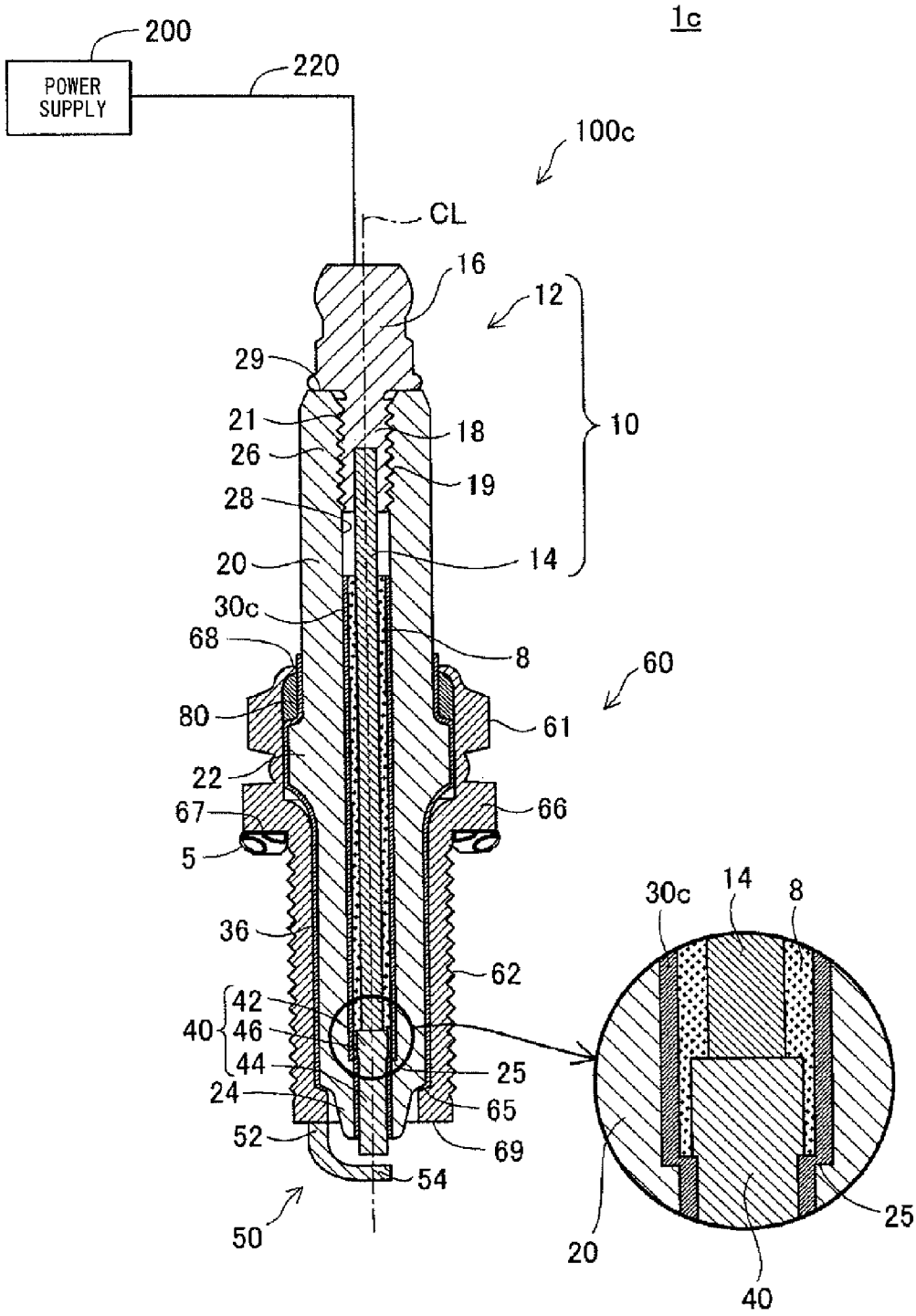
FIG. 4 is a view for explaining an igniter 1*c* used in an experiment for showing one of effects.
Figure 5:
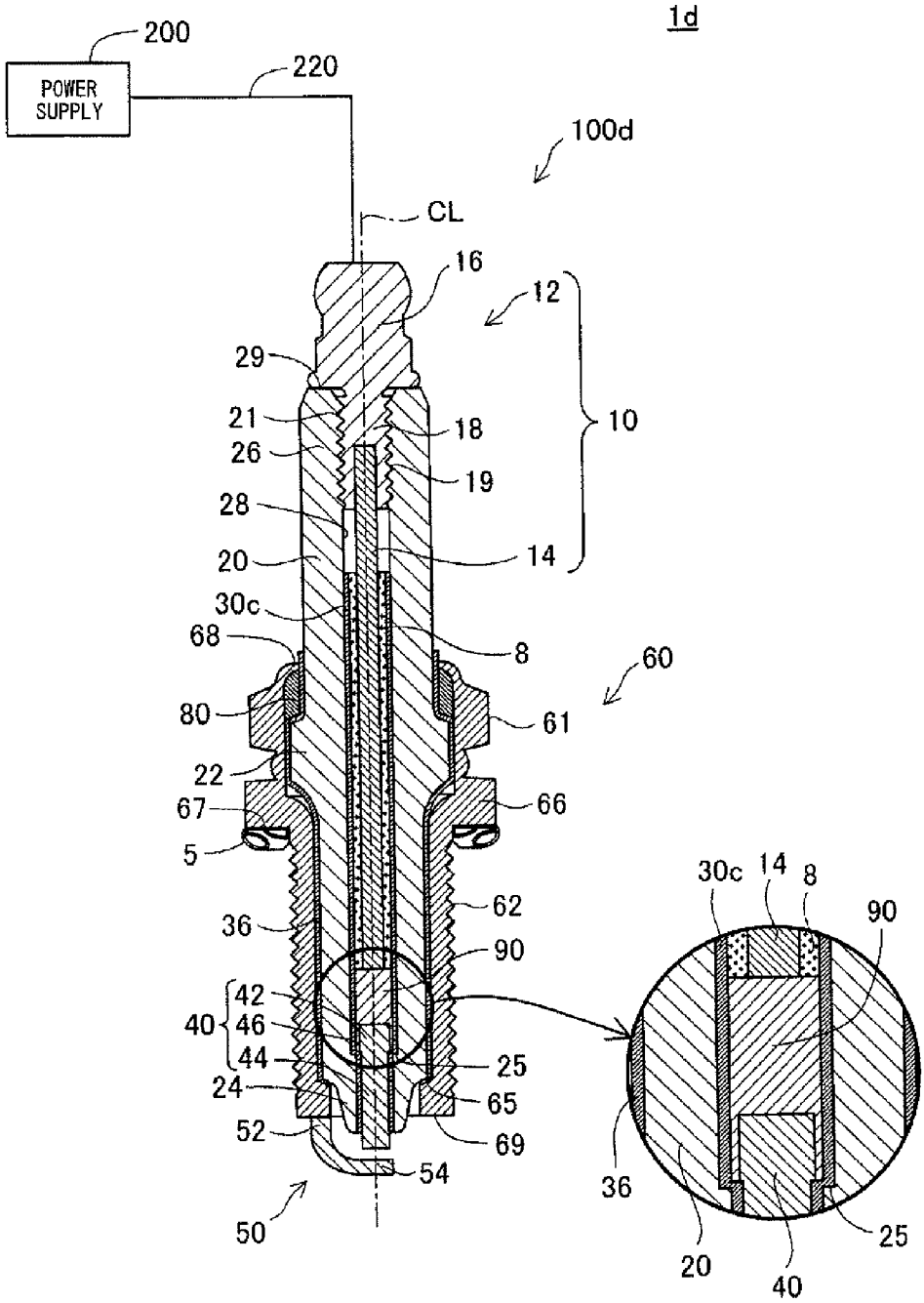
FIG. 5 is a view for explaining an igniter 1*d* used in an experiment for showing one of effects.

FIG. 4 is a view for explaining an igniter 1*c* used in an experiment for showing one of effects. FIG. 5 is a view for explaining an igniter 1*d* used in an experiment for showing one of effects. The igniter 1*c* of FIG. 4 differs from the igniter 1 of the first embodiment in that a metal coating 30*c* does not extend up to the rear end of the inner surface of the axial bore 28 and is in electrical contact with the center electrode 40 at its forward end portion including a portion corresponding to the stepped portion 25. The igniter 1*d* of FIG. 5 differs from the igniter 1*c* of FIG. 4 only in that the electrically conductive glass seal layer 90 is additionally provided between the second terminal 14 and the center electrode 40. In contrast to the igniter 1*c* of FIG. 4, an ignition plug 100*d* of the igniter 1*d* of FIG. 5 has an electrical path of the metal coating 30*c* for supplying power to the center electrode 40 at a position located rearward of the stepped portion 25 (on a side toward the first terminal 12) with respect to the direction of the axis CL.

The experiment was conducted as follows: the ignition plugs 100*c* and 100*d* were disposed such that their forward ends were located within a chamber having a pressure of 0.2 Mpa, and a high-frequency electric power of 300 W having a frequency of 13 MHz was supplied to their metal terminals 10 for 1 msec. The ignition plugs 100*c* and 100*d* were evaluated for the size of generated plasma. A generated plasma was image-captured, and the size (area) of the plasma was calculated from the captured image. The experiment has revealed that the ignition plug 100*d* is greater in the size of generated plasma than the ignition plug 100*c*. More specifically, the ignition plug 100*d* generated plasma which was 9% greater in area than plasma generated by the ignition plug 100*c*. Conceivably, this is for the following reason: as compared with the ignition plug 100*c*, the ignition plug 100*d* is increased in the number of current paths. Specifically, the ignition plug 100*d* has an electrical path for supplying power to the center electrode 40 via the metal coating 30*c*, in addition to an electrical path for supplying power to the center electrode 40 via the metal terminal 10 and the electrically conductive glass seal layer 90. Thus, the ignition plug 100*d* was able to generate plasma having a greater size. That is, because of a reduction in the resistance of the entire electrical path and an associated reduction in power loss, the ignition plug 100*d* generated plasma having a greater size than did the ignition plug 100*c*.

As is understandable from the above-mentioned experiment conducted by use of the ignition plugs 100*c* and 100*d*, the resistance of the entire electrical path can be reduced by the following practice: the metal coating 30*c* is formed on the inner surface of the axial bore 28, and there is increased the number of current paths (electrical paths) extending to the center electrode 40 from a portion of the ignition plug into which current flows from an external source. Accordingly, power loss can be reduced.

D. Modifications

Among the constituent elements in the above-described embodiments, constituent elements other than those appearing in an independent claim are additional ones and can be eliminated as appropriate. The present invention is not limited to the above-described embodiments or modes, but may be embodied in various other forms without departing from the gist of the invention. For example, the following modifications are also possible.

D-1. First Modification

Figure 6:
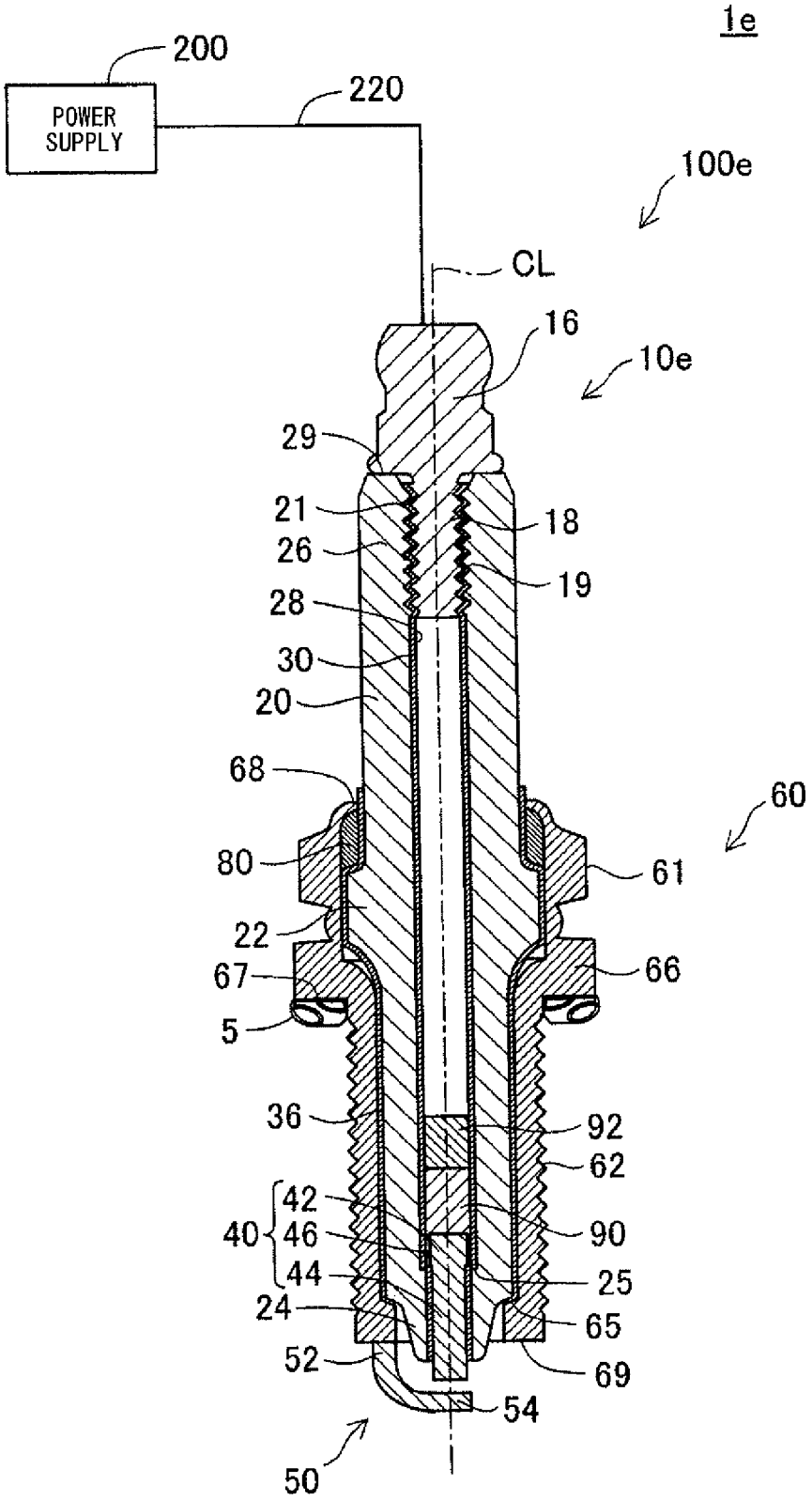
FIG. 6 is a view for explaining an igniter 1*e* of first modification.

FIG. 6 is an explanatory view showing an igniter 1*e* of first modification. In FIG. 6, an ignition plug 100*e* is shown in section. The igniter 1*e* differs from the igniter 1 (FIG. 1) of the above-described first embodiment in the configuration of the ignition plug 100*e*. More specifically, the igniter 1*e* differs from the igniter 1 in that the configuration of a metal terminal 10*e* is modified and that the electrically conductive glass seal layer 90 and a metal rod 92 are additionally provided. Other configurational features are similar to those of the first embodiment and are thus denoted by like reference numerals, and repeated description thereof is omitted.

The metal terminal 10*e* of the ignition plug 100*e* does not have the second terminal 14 extending within the axial bore 28 in the direction of the axis CL, and functions only as the first terminal. Similar to the first terminal 12 (FIG. 1) of the first embodiment, the metal terminal 10*e* is disposed such that the terminal forward portion 18 is disposed within the axial bore 28, while the terminal rear portion 16 projects outward from the rear end surface 29 of the insulator 20. The metal terminal 10*e* is not in direct contact with the center electrode 40. Also, similar to the second embodiment, the ignition plug 100*e* has the electrically conductive glass seal layer 90 disposed within the axial bore 28. The electrically conductive glass seal layer 90 is disposed rearward of the center electrode 40. The ignition plug 100*e* has the circular columnar metal rod 92 disposed in contact with the rear end surface of the electrically conductive glass seal layer 90. The metal rod 92 is formed from metal, such as Fe, Cu, or Ni. Similar to the first embodiment, the ignition plug 100*e* is such that the metal coating 30 is formed on the inner surface of the axial bore 28 along the entire circumference of the inner surface. In the axial bore 28, a hollow space exists between the metal terminal 10*e* and the metal rod 92.

As mentioned above, since the ignition plug 100*e* of the first modification does not require the metal terminal 10*e* to extend within the axial bore 28 up to the vicinity of the center electrode 40, the weight of the ignition plug 10*e* can be reduced, and manufacturing cost can be reduced. Preferably, the metal coating 30 is formed from a material which is higher in electrical conductivity than the metal terminal 10*e*. By virtue of this, the resistance of the electrical path can be further reduced, and power loss can be further reduced.

D-2. Second and Third Modifications

Figure 7A:
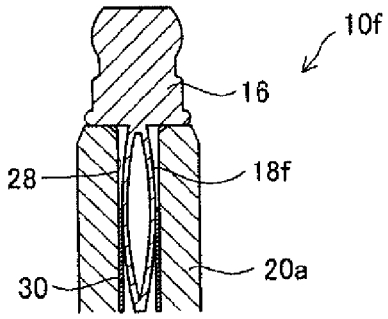
FIGS. 7A and 7B are views for explaining other modifications.
Figure 7B:
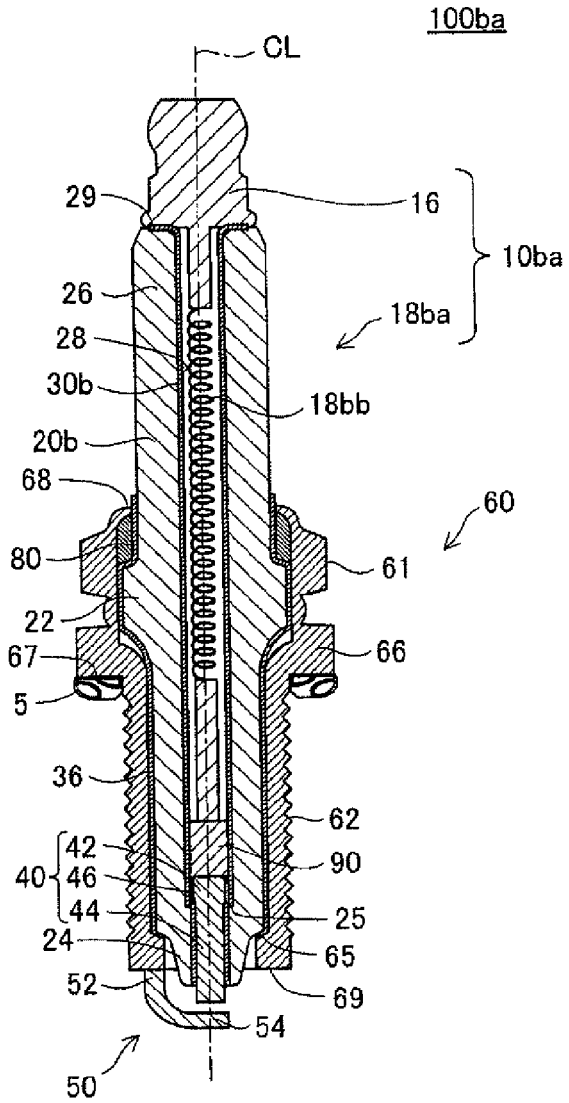

FIGS. 7A and 7B are views for explaining other modifications. FIG. 7A is a view for explaining the second modification, and FIG. 7B is a view for explaining the third modification. FIG. 7B is a sectional view showing an ignition plug 100*ba* of the third modification, which is a modification of the ignition plug 100*b* of the second embodiment.

As represented by a metal terminal 10*f* of FIG. 7A, the metal terminals of the above-described embodiments may have an elastic portion 18*f* disposed within the axial bore 28 and being elastically deformable in a radial direction. The elastic portion 18*f* of the second modification has a substantially elliptic, hollow shape. Similar to other portions of the metal terminal, the elastic portion 18*f* is formed from metal, which is an electrically conductive material. By means of the metal terminal 10*f* having the elastic portion 18*f*, electrical contact can be readily established between the metal coating 30 and the elastic portion 18*f*, which is a portion of the metal terminal 10*f*, by pressing the elastic portion 18*f* into the axial bore 28 of the insulator 20. Thus, efficiency in manufacturing ignition plugs is improved.

As shown in FIG. 7B, a metal terminal 10*ba* may have a coil 18*bb* disposed in a path (electrical path) along which current flows from the terminal rear portion 16 to the center electrode 40. In the third modification, the coil 18*bb* is provided at a terminal forward portion 18*ba*. Other configurational features of the ignition plug 100*ba* are similar to those of the ignition plug 100*b* of the second embodiment and are thus denoted by like reference numerals, and repeated description thereof is omitted. The coil 18*bb* can be applied to the ignition plugs 100 to 100*b* of the above-described embodiments.

D-3. Fourth Modification

In the above-described embodiments, the ignition plugs 100 to 100*b* are supplied with high-frequency electric power from the power supply 200 to generate plasma. However, the method of generating plasma is not limited thereto. For example, plasma may be generated as follows: DC power (e.g., a high voltage of tens of thousands of volts) is supplied from a DC power source, such as an ignition coil, to the ignition plugs 100 to 100*b* to generate a spark discharge between the electrodes 40 and 50. Subsequently, high-frequency electric power is supplied to generate high-frequency plasma between the electrodes 40 and 50.

D-4. Fifth Modification

In the above-described embodiments, the forward ends of the metal coatings 30 and 30*b* of the ignition plugs 100 to 100*b* reach the forward end of the inner surface of the axial bore 28. However, the range of the metal coatings 30 and 30*b* is not limited thereto. The metal coatings 30 and 30*b* may be provided in such a manner as to supply high-frequency electric power to the center electrode 40 therethrough. That is, electrical communication may be established between the center electrode 40 and the metal terminals 10 to 10*b* via the metal coatings 30 and 30*b* through electrical contact of the center electrode 40 with the metal coatings 30 and 30*b* and electrical contact of the metal terminals 10 to 10*b* with the metal coatings 30 and 30*b* at a position located rearward of the center electrode 40. For example, regarding an inner surface of the axial bore 28 which faces the center electrode 40, a portion of the inner surface which is exposed to the interior of a combustion chamber when the ignition plugs 100 to 100*b* are mounted on an internal combustion engine may be free of the metal coatings 30 and 30*b*. For example, in the ignition pug 100 of the first embodiment, the metal coating 30 may not be formed on a portion of the inner surface of the axial bore 28 located forward of the stepped portion 25. Even in this case, similar to the above-described embodiments, the metal coatings 30 and 30*b* establish electrical connection between the metal terminals 10 to 10*b* and the center electrode 40, whereby the resistance of the electrical path can be reduced.

D-5. Sixth Modification

In the above-described embodiments, the metal coatings 30 and 30*b* are formed on the inner surface of the axial bore 28 along the entire circumference. However, the range of circumferential formation of the metal coatings 30 and 30*b* is not limited thereto. For example, the metal coatings 30 and 30*b* may be formed along a portion of the circumference of the inner surface of the axial bore 28. Even in this case, similar to the above-described embodiments, the metal coatings 30 and 30*b* establish electrical connection between the metal terminals 10 to 10*b* and the center electrode 40, whereby the resistance of the electrical path can be reduced.

D-6. Seventh Embodiment

In the above-described embodiments, the metal coating 36 formed on the outer circumferential surface of the insulator 20 extends from the vicinity of the stepped portion 65 to the vicinity of an upper subportion of the flange portion 22 (FIG. 1). However, the range of formation of the metal coating 36 is not limited thereto. For example, the upper end of the metal coating 36 may reach the crimp portion 68 of the metallic shell 60.

DESCRIPTION OF REFERENCE NUMERALS

1 to 1*d*: igniter
5: gasket
10 to 10*c*, 10*f*, 10*ba*: metal terminal
12: first terminal
13: diameter-expanded portion
14: second terminal
16: terminal rear portion
18, 18*b*, 18*ba*: terminal forward portion
18*f*: elastic portion
18*bb*: coil
19: terminal threaded portion
20 to 20*b*: insulator
21: insulator threaded portion
22: flange portion
24: forward end portion
25: stepped portion
26: rear end portion
28: axial bore
29: rear end surface
30, 30*b*, 30*c*: metal coating
36: metal coating
40: center electrode
42: rear center electrode
44: forward center electrode
46: stepped portion
50: ground electrode
52: proximal portion
54: distal portion
60: metallic shell
61: tool engagement portion
62: mounting threaded portion
65: stepped portion
66: seal portion
67: forward end surface
68: crimp portion
69: forward end surface
80: talc
90: electrically conductive glass seal layer
92: metal rod
100 to 100*e*, 100*ba*: ignition plug
200: power supply
220: cable Having described the invention, the following is claimed:

1. An ignition plug comprising:

a tubular insulator having an axial bore extending therethrough in a direction of an axis;

a center electrode disposed in a forward end portion of the axial bore;

a metal terminal disposed rearward of the center electrode in the axial bore, electrically communicating with the center electrode, and supplied with high-frequency electric power from an external source;

a metallic shell disposed in such a manner as to circumferentially surround the insulator; and a ground electrode electrically connected to the metallic shell and adapted to generate plasma in cooperation with the center electrode through supply of the high-frequency electric power to the metal terminal;

wherein at least a portion of an inner surface of the axial bore is coated with a metal coating, the metal terminal and the center electrode electrically communicate with each other through electrical contact of the center electrode with the metal coating and through electrical contact of the metal terminal with the metal coating at a position located rearward of the center electrode;

the metal coating extends on the inner surface of the axial bore at least from a position of the center electrode toward a rear end of the insulator with respect to the direction of the axis; and the metal terminal is in electrical contact with the metal coating at a position within a region extending 20 mm forward from a rear end of the metal coating with respect to the direction of the axis.

2. The ignition plug according to claim 1, wherein the metal coating is higher in electrical conductivity than the metal terminal.

3. The ignition plug according to claim 1, wherein the metal coating is a layer formed from one metal selected from a group of metals consisting of Cu, Ni, Ag, Pt, Rh, Au, W, Co, Be, Ir, Zn, Mg, Al, and Mo, or an alloy which contains as a main component one or more metals selected from the group.

4. The ignition plug according to claim 1, further comprising an electrically conductive glass seal layer gaplessly provided within the axial bore between the metal terminal and the center electrode, wherein a forward end of the metal terminal and a rear end of the center electrode are in contact with the electrically conductive glass seal.

5. An igniter comprising:

a high-frequency electric power supply for supplying high frequency electric power; and an ignition plug including:

a tubular insulator having an axial bore extending therethrough in a direction of an axis;

a center electrode disposed in a forward end portion of the axial bore;

a metal terminal disposed rearward of the center electrode in the axial bore, electrically communicating with the center electrode, and supplied with the high-frequency electric power from the high-frequency electric power supply;

a metallic shell disposed in such a manner as to circumferentially surround the insulator; and a ground electrode electrically connected to the metallic shell and adapted to generate plasma in cooperation with the center electrode through supply of the high-frequency electric power to the metal terminal;

wherein at least a portion of an inner surface of the axial bore is coated with a metal coating;

the metal terminal and the center electrode electrically communicate with each other through electrical contact of the center electrode with the metal coating and through electrical contact of the metal terminal with the metal coating at a position located rearward of the center electrode;

the metal coating extends on the inner surface of the axial bore at least from a position of the center electrode toward a rear end of the insulator with respect to the direction of the axis; and the metal terminal is in electrical contact with the metal coating at a position within a region extending 20 mm forward from a rear end of the metal coating with respect to the direction of the axis.

6. The igniter according to claim 5, wherein the metal coating is higher in electrical conductivity than the metal terminal.

7. The igniter according to claim 5, wherein the metal coating is a layer formed from one metal selected from a group of metals consisting of Cu, Ni, Ag, Pt, Rh, Au, W, Co, Be, Ir, Zn, Mg, Al, and Mo, or an alloy which contains as a main component one or more metals selected from the group.

8. The igniter according to claim 5, wherein the ignition plug further comprises an electrically conductive glass seal layer gaplessly provided within the axial bore between the metal terminal and the center electrode, wherein a forward end of the metal terminal and a rear end of the center electrode are in contact with the electrically conductive glass seal.

9. An ignition plug comprising:

a tubular insulator having an axial bore extending therethrough in a direction of an axis;

a center electrode disposed in a forward end portion of the axial bore;

a metal terminal disposed rearward of the center electrode in the axial bore, electrically communicating with the center electrode, and supplied with high-frequency electric power from an external source;

a metallic shell disposed in such a manner as to circumferentially surround the insulator; and a ground electrode electrically connected to the metallic shell and adapted to generate plasma in cooperation with the center electrode through supply of the high-frequency electric power to the metal terminal;

wherein at least a portion of an inner surface of the axial bore is coated with metal coating;

the metal terminal and the center electrode electrically communicate with each other through electrical contact of the center electrode with the metal coating and through electrical contact of the metal terminal with the metal coating at a position located rearward of the center electrode;

the metal coating is formed at least from a rear end surface of the insulator to the position of the center electrode on the inner surface of the axial bore, said rear end surface being an outer surface of the insulator; and the metal terminal is in electrical contact with the metal coating formed on the rear end surface of the insulator.

10. An ignition plug comprising:

a tubular insulator having an axial bore extending therethrough in a direction of an axis;

a center electrode disposed in a forward end portion of the axial bore;

a metal terminal disposed rearward of the center electrode in the axial bore, electrically communicating with the center electrode, and supplied with high-frequency electric power from an external source;

a metallic shell disposed in such a manner as to circumferentially surround the insulator; and a ground electrode electrically connected to the metallic shell and adapted to generate plasma in cooperation with the center electrode through supply of the high-frequency electric power to the metal terminal;

wherein at least a portion of an inner surface of the axial bore is coated with a metal coating, the metal terminal and the center electrode electrically communicate with each other through electrical contact of the center electrode with the metal coating and through electrical contact of the metal terminal with the metal coating at a position located rearward of the center electrode;

the insulator has an insulator threaded portion having internal threads formed on the inner surface of the axial bore at a position located rearward of the position of the center electrode, and adapted to mount the metal terminal;

the metal terminal has a terminal threaded portion having external threads, disposed in the axial bore, and threadingly engaged with the insulator threaded portion;

the metal coating is formed on the inner surface of the axial bore at least from the insulator threaded portion to the position of the center electrode; and the metal terminal is in electrical contact with the metal coating through threading engagement between the insulator threaded portion and the terminal threaded portion.

* * * * *